US007231168B2

(12) United States Patent
Hirobe

(10) Patent No.: US 7,231,168 B2
(45) Date of Patent: Jun. 12, 2007

(54) IMAGE FORMING APPARATUS

(75) Inventor: Fumitake Hirobe, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 170 days.

(21) Appl. No.: 11/140,998

(22) Filed: Jun. 1, 2005

(65) Prior Publication Data

US 2006/0222415 A1 Oct. 5, 2006

(30) Foreign Application Priority Data

Mar. 31, 2005 (JP) ..... 2005-105458

(51) Int. Cl.
*G03G 15/09* (2006.01)

(52) U.S. Cl. ..... 399/265; 399/269; 399/272

(58) Field of Classification Search ..... 399/265, 399/267, 269, 274, 273, 272, 279, 284
See application file for complete search history.

(56) References Cited

U.S. PATENT DOCUMENTS 5,995,790 A * 11/1999 Takeda ..... 399/274
6,813,462 B2 * 11/2004 Mitsuya et al. ..... 399/269
6,973,281 B2 12/2005 Hirobe et al. ..... 399/269
6,975,825 B2 12/2005 Sakamaki et al. ..... 399/269
6,993,274 B2 1/2006 Hirobe ..... 399/269
7,006,774 B2 2/2006 Saito et al. ..... 399/55
7,010,253 B2 * 3/2006 Kakimoto ..... 399/269
2004/0076451 A1 4/2004 Hirobe ..... 399/252
2005/0238393 A1 10/2005 Hirobe ..... 399/269
2005/0244195 A1 11/2005 Hirobe et al. ..... 399/269

FOREIGN PATENT DOCUMENTS

JP 6-19638 3/1994
JP 2003-323052 11/2003
JP 2004-184988 7/2004

* cited by examiner

*Primary Examiner*—Hoang Ngo
(74) *Attorney, Agent, or Firm*—Fitzpatrick, Cella, Harper & Scinto

(57) ABSTRACT

An image forming apparatus which can stably form an image of high quality by the use of a first developer carrying member and a second developer carrying member. On the first developer carrying member, development is performed by a method whereby a magnetic carrier contacts with an image bearing member, and on the second developer carrying member, development is performed by a method whereby the magnetic carrier does not contact with the image bearing member.

15 Claims, 10 Drawing Sheets

IMAGE FORMING APPARATUS

BACKGROUND OF THE INVENTION

1. Field of the Invention

The invention relates to an image forming apparatus for use in a copying machine, a printer, or facsimile apparatus or the like adopting, for example, an electrophotographic process or an electrostatic recording process.

2. Description of the Related Art

Heretofore, in an image forming apparatus such as a copying machine using an electrophotographic process, an electrostatic latent image formed on an image bearing member such as a photosensitive drum has been visualized by a developer being caused to adhere thereto. As this developer, there is a magnetic mono-component developer including a magnetic toner, a nonmagnetic mono-component developer including a nonmagnetic toner, a dual-component developer including a nonmagnetic toner and a magnetic carrier, or the like, and one of these is suitably used.

Of conventional developing devices in which such developers are used, an example of a developing device using the dual-component developer including the nonmagnetic toner and the magnetic carrier is shown in FIG. 8 of the accompanying drawings.

In the developing device 1 using the dual-component developer as shown in this example, there is often adopted the construction of a single sleeve developing device of a construction containing the dual-component developer in a developer container 2, and provided with a developer carrying member 8 carrying the developer thereon and conveying the developer to develop an electrostatic latent image on a photosensitive drum 10, i.e., a developing sleeve 8*a* and a magnet roll 8*b* provided therein, and further provided in the developer container 2 with conveying screws 5 and 6 which are conveying means for conveying the developer to the developing sleeve 8*a* while agitating the developer.

In such a developing device, however, there occurs in some cases a blank image which is one of image defects by an edge enhancement.

The mechanism of this blank image occurring will hereinafter be described with reference to FIG. 9 of the accompanying drawings. This is an example adopting a reversal developing process.

Usually, the blank image occurs when an image including a highlight image α is formed in an electrostatic latent image formed on the photosensitive drum 10, near the boundary between the highlight image α formed downstream with respect to the moving direction β of the surface of the photosensitive drum 10 and a solid image β formed upstream, i.e., between the trailing edge of the highlight image α and the leading edge of the solid image β.

FIG. 9 shows the shapes of an equipotential surface C and an electric flux line H when there is the highlight portion a on the photosensitive drum 10 and there is the solid portion β behind it and the boundary portion γ between the highlight portion a and the solid portion β is opposed to the developing sleeve 8*a*. It will be seen from this figure that near the boundary portion γ, the electric flux line H is greatly attracted toward the solid portion β.

Accordingly, in the conventional single-sleeve developing process, in a construction wherein the developing sleeve 8*a* is rotated in a forward direction D with the photosensitive drum 10, the toner in the supplied developer cannot be supplied to the trailing edge of the highlight portion α, but is used to develop along the electric flux line H toward the solid portion β and therefore, it is considered that there is a case where a blank area A occurs in the trailing edge portion of the highlight portion α.

So, in order to prevent the blank image, as shown in FIG. 10 of the accompanying drawings, there has been proposed a twin-sleeve developing process provided in a developer container 2 with two developer carrying members 8 and 9 upstream and downstream with respect to the rotation direction of a photosensitive drum 10, i.e., having developing sleeves 8*a* and 9*a* provided with magnet rolls 8*b* and 9*b* therein, and using a dual-component developer for visualizing the same electrostatic latent image on the photosensitive drum 10 by a first developing step executed by the upstream developing sleeve 8*a*, and a second developing step executed by the use of the downstream developing sleeve 9*a* (see, for example, Japanese Patent Application Laid-open No. 2003-323052).

This twin-sleeve developing process is a developing process which reduces the electric potential difference between the highlight portion a and the solid portion β by the above-described first developing step, and which reliably effects development at the trailing edge of the highlight portion α to thereby make it difficult for a blank image to occur.

Further, when the inventor carried out an investigation about an image characteristic, it was found that the dignity of image is determined chiefly by the second developing step.

Specifically, coarseness used in a measure of the quality of image and scavenging occurring in the trailing edge portion of an image are substantially determined by a developing characteristic at the second developing step. Particularly it has been ascertained that coarseness and scavenging occur due largely to such a factor as the mechanical frictional contact between the magnetic carrier in the dual-component developer and the photosensitive drum.

This will hereinafter be described in detail.

The first developing step is a step of developing an electrostatic latent image to thereby eliminate the electric potential difference between the highlight portion and the solid portion. Accordingly, it is desirable that developing efficiency be high. This can be accomplished by lengthening the effective developing time, i.e., setting the circumferential length of a developing nip to a great value. Specifically, a magnetic brush is caused to stay still after the termination of development to thereby earn the developing time, whereby the developing efficiency can be improved.

However, if the developer is caused to stay, as described above, the first developing step will be terminated with the deterioration of the image caused by a counter charge having occurred to the magnetic carrier.

When thereafter, shift is made to the second developing step, the electric potential difference between the highlight portion and the solid portion is reduced and therefore, at the second developing step, in the toner image already formed by the first developing step, the re-disposition of the toner is effected or if the toner does not adhere to that portion of the electrostatic latent image to which the toner should adhere (for example, a portion in which a blank image has occurred), the toner is supplied thereto to thereby achieve a higher quality of image.

However, the adoption of a developing method using a magnetic brush at the second developing step has led to the problem that the toner image already formed by the first developing step is disturbed more than necessary by the magnetic brush.

On the other hand, as a developing method not using a magnetic carrier, study has been made about a nonmagnetic toner mono-component developing method, as shown in FIG. 11 of the accompanying drawings (see, for example, Japanese Patent Application Laid-open No. 2004-184988).

This developing device has a developing roller 8 as a developer carrying member contacting with a photosensitive drum 10, a supplying and collecting roller 80 for supplying and collecting a toner to the developing roller 8, and an elastic blade 81 abutting against the developing roller 8. The elastic blade 81 regulates the layer thickness of the toner supplied to the developing roller 8 and also, gives predetermined triboelectrification charges to the toner.

The developing device of such a construction does not use a magnetic carrier and therefore has the advantage that there is no noise component based on the magnetic carrier and thus, a higher quality of image can be achieved easily.

However, the charge giving (hereinafter referred to as the "tribo") to the nonmagnetic toner must be effected by only an extraneous additive to the toner and the elastic blade, and the stability of the tribo is spoiled by the deterioration of the elastic blade with time and the deterioration or the like of the toner due to the stress by the toner supplying and collecting roller. As a result, the developing characteristic is changed, and this has led to a great problem regarding durability.

Further, the magnetic carrier is not used and therefore the developing efficiency of the toner has been very bad, and the deterioration of image such as an edge enhancement has been liable to occur.

So, in order to solve the above-noted problems, as shown in FIG. 12 of the accompanying drawings, there has been proposed a developing method of taking out only a nonmagnetic toner component from a dual-component developer contained in a developer container 2, and conveying it to a developer carrying member and using it for development (see, for example, Japanese Patent Publication No. H06-19638).

In this developing device, a developer carrying member 8 is provided with a developing sleeve 8*a* and a magnet roll 8*b* provided in the interior of the developing sleeve 8*a*, and an elastic blade 82 is provided so as to abut against the developing sleeve 8*a*. Also, a nonmagnetic mono-component developer and a slight amount of magnetic particles 83 are contained in a developer container 2. When in this construction, the developing sleeve 8*a* is rotated in a direction indicated by the arrow E, the magnetic particles 83 in the developer container 2 are blocked by the elastic blade 82, and only the nonmagnetic mono-component developer is carried on the surface of the developing sleeve and is conveyed to a developing area opposed to a photosensitive drum 10.

This method is a developing method which can satisfy the stability of durability resulting from the use of the mono-component developer and a higher quality of image resulting from the use of the mono-component developer.

However, an improvement in low developing efficiency resulting from the use of the mono-component developer is not achieved.

SUMMARY OF THE INVENTION

It is an object of the present invention to provide an image forming apparatus which can stably form an image of high quality by the use of a first developer carrying member and a second developer carrying member.

It is another object of the present invention to provide an image forming apparatus which can prevent a faulty image from being caused by a developer image on an image bearing member developed by a first developer carrying member being disturbed by a developer image on a second developer carrying member.

The above objects are achieved by an image forming apparatus according to the present invention. Summing up, the present invention provides an image forming apparatus having:

an image bearing member on which an electrostatic image is formed; and a developing device provided with a developer container containing therein a developer including a magnetic carrier and a nonmagnetic toner, and first and second developer carrying members disposed in the opening portion of the developer container in opposed relationship with the image bearing member for developing the common electrostatic image on the image bearing member, wherein on the first developer carrying member, development is effected by a method whereby the magnetic carrier contacts with the image bearing member, and on the second developer carrying member, development is effected by a method whereby the magnetic carrier does not contact with the image bearing member.

According to an embodiment of the present invention, an image of high quality can be obtained without a developer image formed by the first developer carrying member being disturbed by the developer by the second developer carrying member, and by slight scavenging made during a first developing step being removed.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

An image forming apparatus according to the present invention will hereinafter be described in greater detail with reference to the drawings.

Embodiment 1

Figure 1:
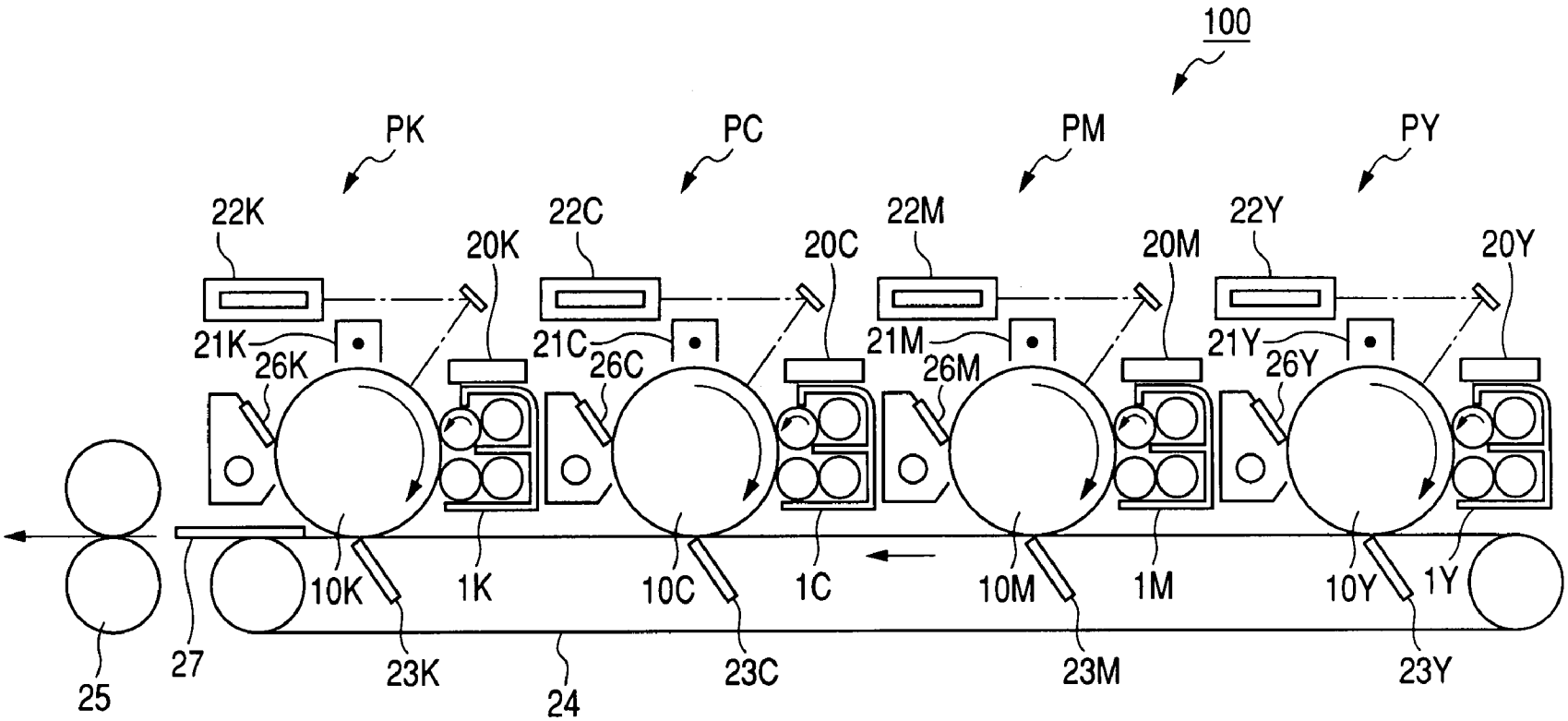
FIG. 1 schematically shows the construction of an embodiment of an image forming apparatus according to the present invention.

Reference is first had to FIG. 1 to schematically describe the construction of an embodiment of the image forming apparatus according to the present invention, and then describe a developing device constituting the characteristic portion of the present invention. In the present embodiment, the image forming apparatus is a tandem type multi-color image forming apparatus utilizing an electrophotographic process, but the present invention is not restricted thereto.

According to the present embodiment, the multi-color image forming apparatus is provided with yellow (Y), magenta (M), cyan (C) and black (K) image forming portions, i.e., image forming stations P (PY, PM, PC, PK) and a conveying belt 24 as a transfer material conveying member for bearing and conveying a transfer material S.

The image forming stations P (PY, PM, PC, PK) are substantially similar in construction to one another, and form yellow (Y), magenta (M), cyan (C) and black (K) images, respectively, in a full-color image.

The conveying belt 24 attracts transfer paper 27 as a recording material and conveys it to the image forming stations P (PY, PM, PC, PK). Developer images, i.e., toner images, formed in the image forming stations P (PY, PM, PC, PK) are transferred to the transfer paper 27, whereby a full-color image is formed on the transfer paper 27.

Further describing the image forming stations P (PY, PM, PC, PK), these image forming stations P (PY, PM, PC, PK) are provided with rotary drum-shaped electrophotographic photosensitive members, i.e., photosensitive drums 10 (10Y, 10M, 10C, 10K) repetitively used as image bearing members and rotatively driven at a predetermined peripheral speed (process speed) in a clockwise direction indicated by arrow. Around the respective photosensitive drums 10 (10Y, 10M, 10C, 10K), there are disposed primary charging devices 21 (21Y, 21M, 21C, 21K) as charging apparatuses for uniformly charging the surfaces of the photosensitive drums 10, image exposing apparatuses 22 (22Y, 22M, 22C, 22K) for exposing the photosensitive drums 10 (10Y, 10M, 10C, 10K) to light to thereby form electrostatic latent images thereon, developing devices 1 (1Y, 1M, 1C, 1K) for developing the electrostatic latent images formed on the photosensitive drums 10 (10Y, 10M, 10C, 10K), and cleaning apparatuses 26 (26Y, 26M, 26C, 26K) for removing the toners on the photosensitive drums 10 (10Y, 10M, 10C, 10K).

Also, inside the conveying belt 24, there are disposed, at locations opposed to the respective photosensitive drums 10 (10Y, 10M, 10C, 10K), transfer charging devices as transfer apparatuses, in the present embodiment, transfer blades 23 (23Y, 23M, 23C, 23K).

In the following description, for example, the developing device 1, if mentioned, refers to the developing device 1Y, the developing device 1M, the developing device 1C and the developing device 1K in common in the respective image forming stations P (PY, PM, PC, PK). This also holds true with regard to the other apparatuses and members.

The operation of the entire image forming apparatus of the above-described construction will now be described with reference to FIG. 1.

The photosensitive drum 10 which is an image bearing member is rotatably provided, and this photosensitive drum 10 is uniformly charged by the primary charging device 21, and is exposed to light modulated in accordance with an image information signal by the image exposing apparatus 22 provided with a light emitting element such as, for example, a laser, to thereby form an electrostatic latent image thereon.

The electrostatic latent image is visualized as a developer image (toner image) by the developing device 1 via a developing step which will be described later. The toner image on the photosensitive drum 10 of each image forming station P is transferred from the photosensitive drum 10 onto the transfer paper 27 conveyed thereto, by the transfer blade 23, and a full-color toner image is formed on the transfer paper 27. Then, the full-color toner image on the transfer paper 27 is fixed on the transfer paper 27 by a fixing apparatus 25 and becomes a permanent image. Also, any untransferred residual toner on the photosensitive drum 10 is removed by the cleaning apparatus 26.

On the other hand, the toner in the developer in the developing device 1 consumed by the developing step is sequentially supplied from a toner supplying tank 20 to thereby make the density of the toner in the developing device 1 proper.

Also, while in the present embodiment, there has been adopted a method whereby the toner images are directly transferred from the photosensitive drums 10M, 10C, 10Y, 10K to the transfer paper 27 which is a recording material on the conveying belt 24, the present invention can also be applied to an image forming apparatus of a construction in which, for example, a belt-shaped intermediate transfer member is provided instead of the conveying belt 24, and toner images of respective colors are successively primary-transferred from the photosensitive drums 10M, 10C, 10Y, 10K of the respective colors to an intermediate transfer member, whereafter the compound toner image of the respective colors is collectively secondary-transferred to the transfer paper.

An embodiment of the developing device 1 forming the feature of the present invention will now be described with reference to FIG. 2.

The developing device 1 according to the present embodiment has, in a developer container 2 containing therein a dual-component developer including a nonmagnetic toner and a magnetic carrier, a first developer carrying member 8 and a second developer carrying member 9 rotatably disposed in opposed relationship with the photosensitive drum 1 for carrying thereon and conveying the developer in the developer container 2. The first developer carrying member 8 is disposed upstream of the second developer carrying member 9 with respect to the moving direction of the photosensitive drum 1, and the second developer carrying member 9 is disposed downstream of the first developer carrying member 8 with respect to the moving direction of the photosensitive drum 1.

Also, in the developer container 2, there are provided a regulating blade 11 which is a developer layer thickness regulating member provided in proximity to the surface of the first developer carrying member 8 for regulating the layer thickness of the developer carried on the surface of the first developer carrying member 8, and two conveying screws 5 and 6 as developer agitating and conveying members for agitating and conveying the developer.

Describing in greater detail, in the present embodiment, the first and second developer carrying members 8 and 9 are roll-shaped rotary members (hereinafter referred to as the "developing rolls"), and are disposed up and down in the present embodiment, in the opening portion of the developer container 2 which faces the photosensitive drum 10 and are rotatably journalled.

In the present embodiment, the first developing roll 8 is formed by a nonmagnetic cylindrical rotary member, i.e., a developing sleeve 8*a*, and a magnet roll 8*b* which is fixed magnetic field generating means provided against rotation in the developing sleeve 8*a*. Also, the second developing roll 9 is formed by a nonmagnetic cylindrical rotary member, i.e., a developing sleeve 9*a*, in which magnetic field generating means is not disposed.

The rotational directions of the first and second developing sleeves 8*a* and 9*a* are the same direction (a counterclockwise direction in FIG. 2) so as to be opposite directions in areas opposed to each other, and the rotational speeds (peripheral speeds) thereof are designed to be substantially the same.

Also, in the present embodiment, the rotation directions of the first and second developing sleeves 8*a* and 9*a* are the same direction as the rotation direction of the photosensitive drum 10, i.e., a forward direction, in first and second developing portions (developing areas) 12 and 13 opposed to the photosensitive drum 10. Of course, the rotation directions and peripheral speeds of the first and second developing sleeves 8*a* and 9*a* are not restricted thereto, but can be suitably changed. For example, the rotation direction of one or both of the first and second developing sleeves 8*a* and 9*a* can be made opposite to the rotation direction of the photosensitive drum 10 in the developing areas 12 and 13 opposed to the photosensitive drum 10. In this case, the position of the regulating blade 11 and further, the magnetic pole disposition of the magnet roll 8*b* are also suitably changed.

Also, in the developer container 2, a developing chamber 3 and an agitating chamber 4 comparted by a partition wall 7 are formed up and down on a side opposite to the opening portion in which the first and second developing sleeves 8*a* and 9*a* are disposed.

First and second conveying screws 5 and 6 as developer agitating and conveying means are installed in the developing chamber 3 and the agitating chamber 4, respectively, constituting the circulation route of the developer. The first conveying screw 5 conveys the developer in the developing chamber 3, and the second conveying screw 6 agitates and conveys the toner supplied from a toner supplying port (not shown) to the upstream side of the second conveying screw 6 in the agitating chamber 4 and the developer already being in the agitating chamber 4.

Figure 3:
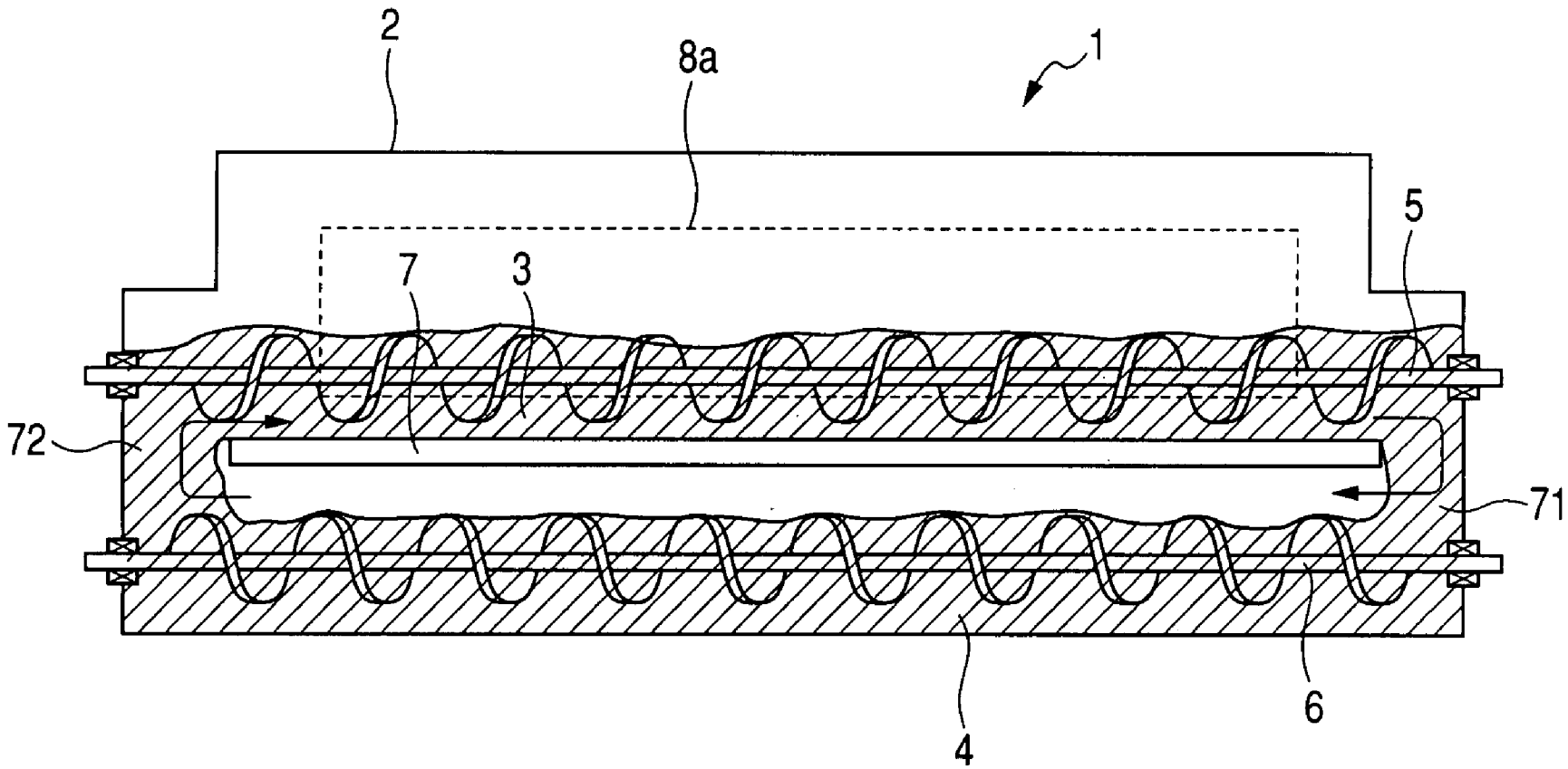
FIG. 3 is a cross-sectional view illustrating the circulation of a developer in the developing device.

The partition wall 7 is formed with an opening 71 near an axial end of the first and second conveying screws 5 and 6, as shown in FIG. 3, and through this opening 71, the developer is supplied from the developing chamber 3 to the agitating chamber 4 by gravity.

On the other hand, the developer in the developing chamber 3 is drawn up onto the developing sleeve 8 by the magnetic pole N1 of the magnet roll 8*b* which is the magnetic field generating means provided against rotation in the developing sleeve 8*a* and which is located in the interior of the developer container 2, and is conveyed to magnetic poles S1→N2 on the developing sleeve 8*a* with the rotation of the developing sleeve 8*a*, and comes to the first developing portion 12 lying at the position of a developing magnetic pole S2 whereat the developing sleeve 8*a* and the photosensitive drum 10 are opposed to each other. In the course of conveyance, the developer has its layer thickness magnetically regulated by the developer regulating blade 11 cooperating with the magnetic pole S1 lying at a position substantially opposed thereto, whereby a thin layer of the developer is achieved and in the first developing portion 12, the first developing step for the electrostatic image on the photosensitive drum 10 is executed by magnet brush contact development.

Describing here the first developing step in the first developing portion 12, the first developing step is a step of developing the electrostatic latent image to thereby eliminate the electric potential difference between a highlight portion and a solid portion (charging step). Specifically, it is practiced to charge the toner layer surface potential to the vicinity of developing DC bias potential applied by a DC power source 31 constituting electric field generating means which will be described later in detail.

That is, in an ideal state, a state in which the developing DC bias potential and the toner layer surface potential become substantially the same potential (electric potential difference zero) can be regarded as the complete termination of development.

So, the inventor measures the toner layer surface potential by an external potentiometer to thereby define charging efficiency (a value obtained by dividing the toner layer surface potential by the developing DC bias potential is referred to as the "charging efficiency"). In order to enhance this charging efficiency, a developing bias waveform, the nip shape of the first developing portion 12, a magnetic carrier resistance value, etc. are optimized, whereby nearly 100% can be achieved.

In the present embodiment, it is possible to make the developing DC bias potential applied to the first developing sleeve 8*a*—the photosensitive drum potential difference (hereinafter referred to as the "Vback potential") smaller than in the conventional art to thereby achieve further efficiency.

Thereafter, any developer left without being used for development in the first developing portion 12 is conveyed to the interior of the developer container 2 by a magnetic pole N3 located downstream of the first developing portion 12 with respect to the rotation direction of the developing sleeve 8*a*, is removed from the developing sleeve 8*a* by the repulsive magnetic field of the magnetic poles N1 and N3, and is collected into the agitating chamber 4 in the lower portion of the developer container 2.

The collected developer is agitated and conveyed toward the other end side by the conveying screw 6 so as to be sufficiently mixed with the supplied toner, and is delivered to the developing chamber 3 through a communication path 72 (FIG. 3). Then, the developer conveyed from the communication path 72 is supplied to the developing sleeve 8*a* while being agitated and conveyed by the conveying screw 5. The developer is designed to be thus circulated.

As described above, in the present embodiment, the first developer carrying member, i.e., the developing roll 8, has at least the rotatable nonmagnetic developing sleeve 8*a* and the magnet roll 8*b* as the magnetic field generating means fixedly disposed in the interior of this developing sleeve 8*a*.

The nonmagnetic cylindrical member which is the developing sleeve 8*a* may preferably be formed of an electrically conductive material, and as such a material, use can be made, for example, of one of various heretofore known materials such as a metal, e.g. stainless steel, aluminum or the like, and a resin material to which electrical conductivity has been given by the dispersion of electrically conductive particles. Also, the developing sleeve 8*a* may be subjected to working such as roughening the surface thereof by blast treatment or the like in order to enhance the conveyability of the developer.

As the magnet roll 8*b* which is the magnetic field generating means, a plurality of magnetic poles are fixed to the interior of the developing sleeve 8*a* so as to be immovable relative to the developing sleeve 8*a*. The magnet roll 8*b* may be a magnet or the like normally generating a magnetic field, or an electromagnet or the like which can arbitrarily generate a constant magnetic field or magnetic fields of different polarities.

A description will now be made of the second developing step executed by only the nonmagnetic toner in the developing device 1 which is a feature of the present embodiment.

A description will hereinafter be made of a method of separating only the nonmagnetic toner from the dual-component developer and conveying it in order to effect the second developing step by only the nonmagnetic toner.

The second developing roll 9, as described above, is constituted by a nonmagnetic cylindrical member, i.e., the developing sleeve 9*a*, which may preferably be formed of a nonmagnetic and electrically conductive material. Accordingly, the developing sleeve 9*a* can also be made by the use of the same material as that of the developing sleeve 8*a* forming the first developing roll 8.

Toner separating and conveying means is provided to separate and convey only the nonmagnetic toner in the dual-component developer to the developing sleeve 9*a* as the second developing roll 9. In the present embodiment, the first developing roll 8 acts as the toner separating and conveying means.

Figure 2:
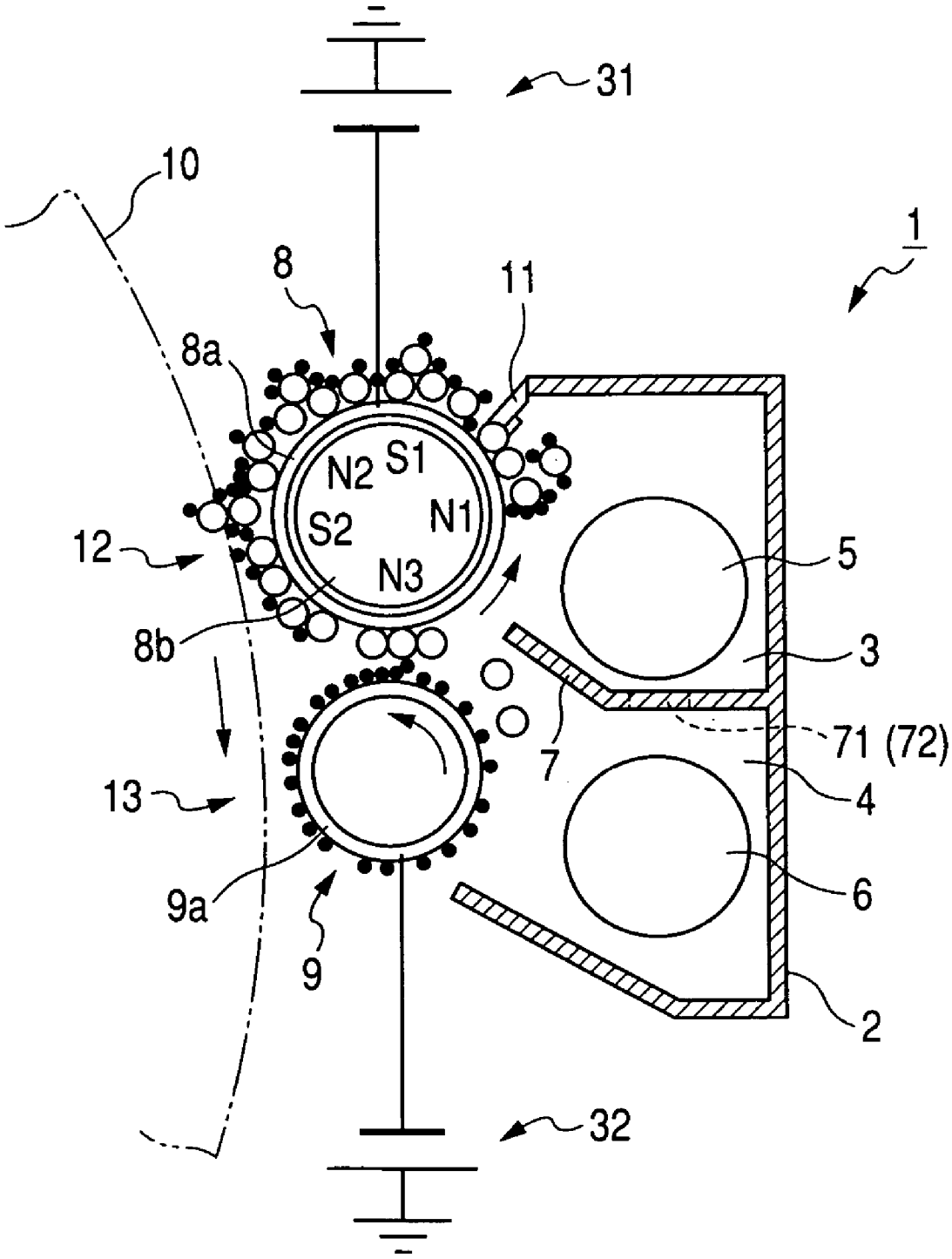
FIG. 2 is a cross-sectional view showing an embodiment of a developing device constructed in accordance with the present invention.

In the present embodiment, as shown in FIG. 2, DC power sources 31 and 32 are provided as electric field generating means, and the DC power source 31 is connected to the first developing sleeve 8*a* and the DC power source 32 is connected to the second developing sleeve 9*a*, and a DC developing bias is applied to each of the first developing sleeve 8*a* and the second developing sleeve 9*a*.

That is, in the present embodiment, the conveyance of the toner from the first developing roll 8 to the second developing roll 9 is effected by generating an electric field between the first developing roll 8 and the second developing roll 9, and the electric potential difference between the first developing roll 8 and the second developing roll 9. That is, in the present embodiment, developing DC bias values applied to the developing sleeve 8*a* and the developing sleeve 9*a* were changed to thereby cause an electric potential difference between the two sleeves 8*a* and 9*a*.

Specifically, in the present embodiment, the dark portion potential of the photosensitive drum 10 was set to −700 V and the light portion potential thereof was set to −100 V, and −650 V (Vback potential 50 V) was applied as a DC bias to the developing sleeve 8*a* by the DC power source 31.

On the other hand, −450 V was applied as a DC bias to the developing sleeve 9*a* by the DC power source 32 in order to provide an electric potential difference of 200 V between it and the developing sleeve 8*a*.

As a result, due to the electric potential difference between the developing sleeve 8*a* and the developing sleeve 9*a*, only the nonmagnetic toner to the developing sleeve 9*a* is used for developing (jumping), and a coat of only a nonmagnetic toner layer is achieved on the surface of the developing sleeve 9*a*.

Thereafter, the developing sleeve 9*a* is rotated, whereby the nonmagnetic toner carried on the developing sleeve 9*a* comes to the second developing portion 13 in which the developing sleeve 9*a* and the photosensitive drum 10 are opposed to each other, and the second developing step by non-contact development is executed for the electrostatic latent image on the photosensitive drum 10.

At this second developing step (i.e., the toner re-disposing and correcting step), the toner flies to a blank image occurring portion such as a highlight trailing edge portion which could not be sufficiently developed by the first developing step to thereby improve the blank image level and further, a faulty image portion based on the magnetic carrier caused at the first developing step is corrected, whereby an image of very high dignity can be obtained.

Further, as a feature of the present embodiment, there is not required an elastic roller for supplying and stripping off the toner or an elastic blade for giving charges to the toner which was indispensable in the conventional nonmagnetic mono-component developing method and therefore, the deterioration of the toner by stress applied to the toner can be remarkably mitigated.

Also, by using the dual-component developer, a toner having a stable charging characteristic can be used at the second developing step and therefore, sufficiently wide fog latitude could be achieved easily.

Further, at the first developing step, as described above, the Vback potential is set to a value lower than a usually set value (about 100–200 V) and therefore, the developing contrast potential (the developing DC bias potential—the light portion potential) in the first developing portion 12 could be made high, and the developing property could be improved and yet, the carrier adherence latitude at the first developing step could be greatly improved.

Also, in the present embodiment, use was made of such a dual-component developer including a nonmagnetic toner and a low-magnetization high-resistance carrier as will be described below.

The nonmagnetic toner is constituted by using binding resin such as styrene resin or polyester resin, a coloring agent such as carbon black, a dye or a pigment, a mold releasing agent such as wax, a charge controlling agent or the like in a suitable amount. Such a nonmagnetic toner can be manufactured by an ordinary method such as a crushing method or a polymerizing method.

The nonmagnetic toner (negative charging characteristic) may preferably have a triboelectrification charge amount of the order of $-1\times10^{-2}$ to $-5.0\times10^{-2}$ C/kg. If the triboelectrification charge amount of the nonmagnetic toner departs from the above-mentioned range, the developing efficiency will lower and a counter charge amount occurring to the magnetic carrier will become great and thus, the blank image level will be aggravated, and a faulty image may occur. The triboelectrification charge amount of the nonmagnetic toner may be adjusted by the kind or the like of the material used, or may be adjusted by the addition of an extraneous additive which will be described later.

The triboelectrification charge amount of the nonmagnetic toner can be measured by sucking the toner from the developer of about 0.5 to 1.5 g by air-sucking by the use of an ordinary blow-off method, and measuring a charge amount induced in a measuring container.

Also, as the magnetic carrier, use can be made of a heretofore known one, but use can also be made, for example, of a resin carrier formed by magnetite being dispersed as a magnetic material in resin, and carbon black dispersed for the purposes of electrical conductivity and resistance adjustment, or the surface of magnetite simple substance such as ferrite oxidized and reduction-treated to thereby effect resistance adjustment, or the surface of magnetite simple substance such as ferrite coated with resin to thereby effect resistance adjustment, or the like. A method of manufacturing these magnetic carriers is not particularly limited.

The magnetic carrier may preferably have magnetization of $3.0\times10^4$ A/m to $2.0\times10^5$ A/m in a magnetic field of 0.1 tesla. If the magnetization amount of the magnetic carrier is made small, there will be the effect of suppressing the scavenging by a magnetic brush, but the adherence of the magnetic carrier to the nonmagnetic cylindrical member by the magnetic field generating means will become difficult, and a faulty image such as the adherence of the magnetic carrier to the photosensitive drum or the aforedescribed sweeping-together image may be caused. Also, if the magnetization of the magnetic carrier is greater than the above-mentioned range, a faulty image may be caused by the pressure of the magnetic brush, as described above.

Further, the volume resistivity of the magnetic carrier may preferably be $10^7$ to $10^{14}$ Ωcm with leak and developing property taken into account.

The magnetization of the carrier was measured by the use of a vibration magnetic field type characteristic automatic recording apparatus BHV-30 produced by Riken Denshi (Ltd.). The magnetic characteristic value of the carrier powder is obtained by making an external magnetic field of 0.1 T, and finding the intensity of the then magnetization. The carrier is brought into a state packed in a cylindrical plastic container so as to become sufficiently close. In this state, the magnetization moment is measured, and the actual weight when a sample was put in is measured to thereby find the intensity of the magnetization ($Am^2/kg$). Then, the true specific gravity of the carrier particles is found by a dry type automatic density type Accupyc 1330 (produced by Shimadzu Corporation), and the intensity of the magnification ($Am^2/kg$) is multiplied by the true specific gravity, whereby there can be found the intensity of the magnification (A/m) per unit volume used in the present embodiment.

By adopting such a construction, there can be achieved an improvement in developing efficiency and the prevention of the scavenging and blank image phenomena which are the advantages of a developing construction having the first developing sleeve 8*a* and the second developing sleeve 9*a*.

Figure 4A:
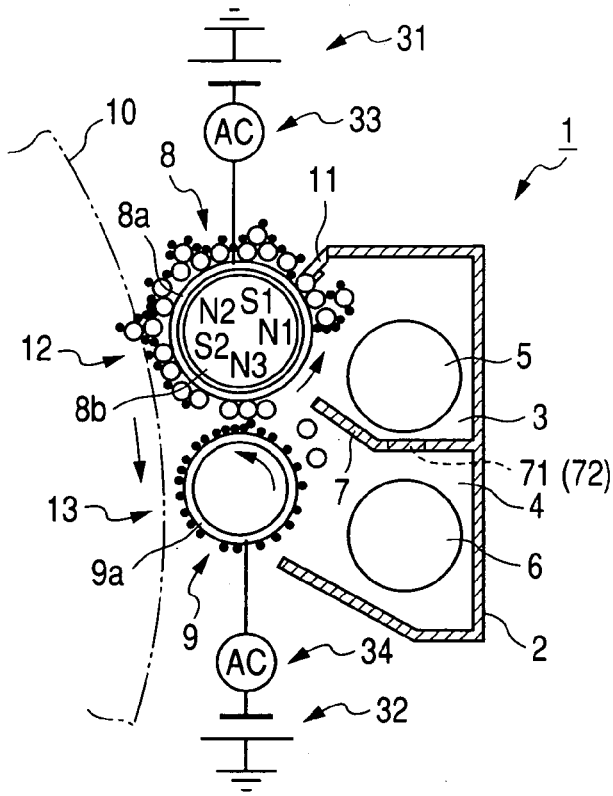
FIGS. 4A and 4B are cross-sectional views showing another embodiment of the developing device constructed in accordance with the present invention.

As the electric field generating means, as shown in FIG. 4A, AC power sources 33 and 34 can be further provided and a vibration bias voltage comprising an AC voltage and a DC voltage superimposed thereon can be applied to the developing sleeves 8*a* and 9*a* to thereby further gain the developing efficiency. The AC bias can be a developing bias having a peak-to-peak voltage Vpp of 1.85 kV and a frequency Frg of 12 kHz.

Figure 4B:
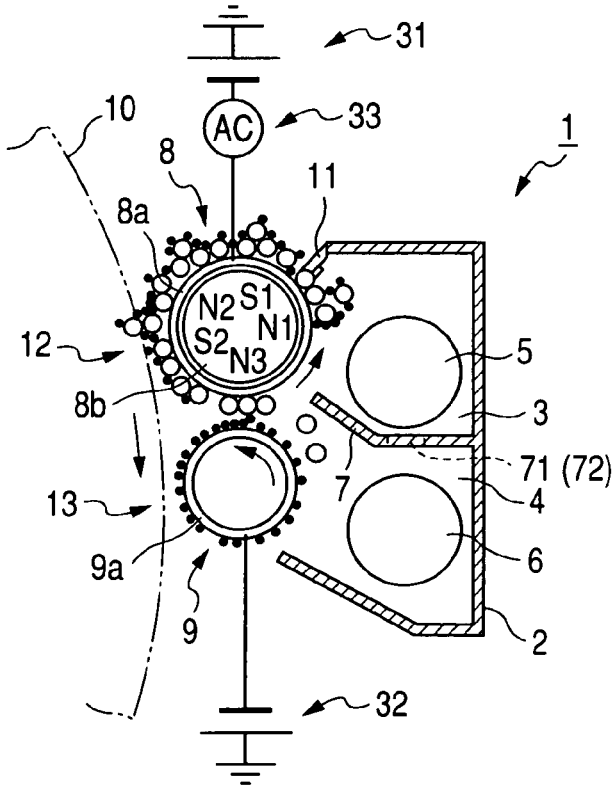

Also, as shown in FIG. 4B, a vibration bias comprising an AC voltage and a DC voltage superimposed thereon are applied from the DC power source 31 and the AC power source 33 to the first developing sleeve 8*a*, and only a DC voltage can be applied from the DC power source 32 to the second developing sleeve 9*a*, and again in this case, of course, an operational effect similar to that of the above-described embodiment can be achieved.

As a process condition which determines the developing characteristic, there is the developing sleeve-drum interval (SD). In the present embodiment, SD between the first developing roll 8 and the photosensitive drum 10 and SD between the second developing roll 9 and the photosensitive drum 10 were 300 μm and 150 μm, respectively, whereby a good result could be obtained.

Also, as a result of studies and experiments further carried out, it is also possible to adopt a so-called contact developing method (i.e., SD=0) adopting a construction in which as the second developing roll 9, the surface of the developing sleeve 9*a* is coated with an elastic layer member, for example, silicone rubber as a base layer is coated with ether urethane or nylon as a surface layer, or a construction in which an elastic rubber layer as a surface layer is provided on a foamed material such as sponge as a base layer, and the photosensitive drum 10 is pressed by total pressure of e.g. 1 KG.

As described above, in the present embodiment, the dual-component developer was used and there were provided two developer carrying members and two developing portions, whereby the developing efficiency could be improved and a countermeasure for preventing a blank image was provided, whereby a higher quality of image could be achieved.

At the first developing step, toner layer potential is charged up to substantially the potential of the developing sleeve 8*a*, and at the second developing step, such problems as the coarseness and scavenging phenomenon by the magnetic brush on the first developing sleeve 8*a* which occurred at the first developing step are corrected and yet, a faulty image such as a blank image can be prevented.

The developing device according to the present embodiment is a developing device containing therein a dual-component developer consisting of a magnetic carrier and a nonmagnetic toner mixed together, and carries the dual-component developer on the first developer carrying member by a magnetically formed magnetic brush, and carries only the nonmagnetic toner on the second developer carrying member, and develops the same electrostatic image formed on the image bearing member in each developing portion (that is, effects the developing step twice for an electrostatic image).

The magnetic carrier is provided with the characteristic of being triboelectrification-charged to the nonmagnetic toner, and this "triboelectrification charging" is effected by the developer being agitated and conveyed when circulated in the developer container.

As described above, according to the present embodiment, the first developer carrying member carries thereon the dual-component developer contained in the developing device and effects the conveyance thereof to the first developing portion and the developing step, and the second developer carrying member carries thereon only the nonmagnetic toner in the dual-component developer and effects the conveyance thereof to the second developing portion and the developing step and therefore, the earing by the magnetic carrier in the dual-component developer does not occur at the second developing step. Accordingly, the developer image formed by the first developer carrying member is not disturbed by the developer by the second developer carrying member and further, minute scavenging made during the first developing step can be removed to thereby obtain an image of high quality.

Also, the image forming apparatus provided with the developing device of the above-described construction is not restricted to the form of the image forming apparatus of the above-described construction, but can adopt various forms.

Embodiment 2

In Embodiment 1, a great deal of magnetic carrier having counter charges exists on the first developing sleeve 8*a* immediately after the termination of development. The counter charges refer to charges produced in the magnetic carrier by the toner used to develop the electrostatic latent image, and these charges exist much in the magnetic carrier after the termination of development.

Since as described above, the magnetic carrier after the termination of development has counter charges, it has sometimes happened that Coulomb's force occurring between the carrier and the toner increases and for an electric potential difference of 200 V, jumping coat onto the second developing sleeve 9 cannot be sufficiently done. This has remarkably occurred particularly when an image of a high image percentage like a solid image has been taken.

So, studies were carried out by making the distance between the first and second developing sleeves 8*a* and 9*a* greater, but the intensity of an electric field became weak, whereby there arose the problem that the jumping force further weakened.

Also, the first developing sleeve 8*a* and the second developing sleeve 9*a* has an electric potential difference therebetween and therefore, there arose the problem that the flying efficiency of the toner toward the photosensitive drum 10 dropped. This remarkably appeared when the resistance value of the magnetic carrier in the dual-component developer was great.

Figure 5:
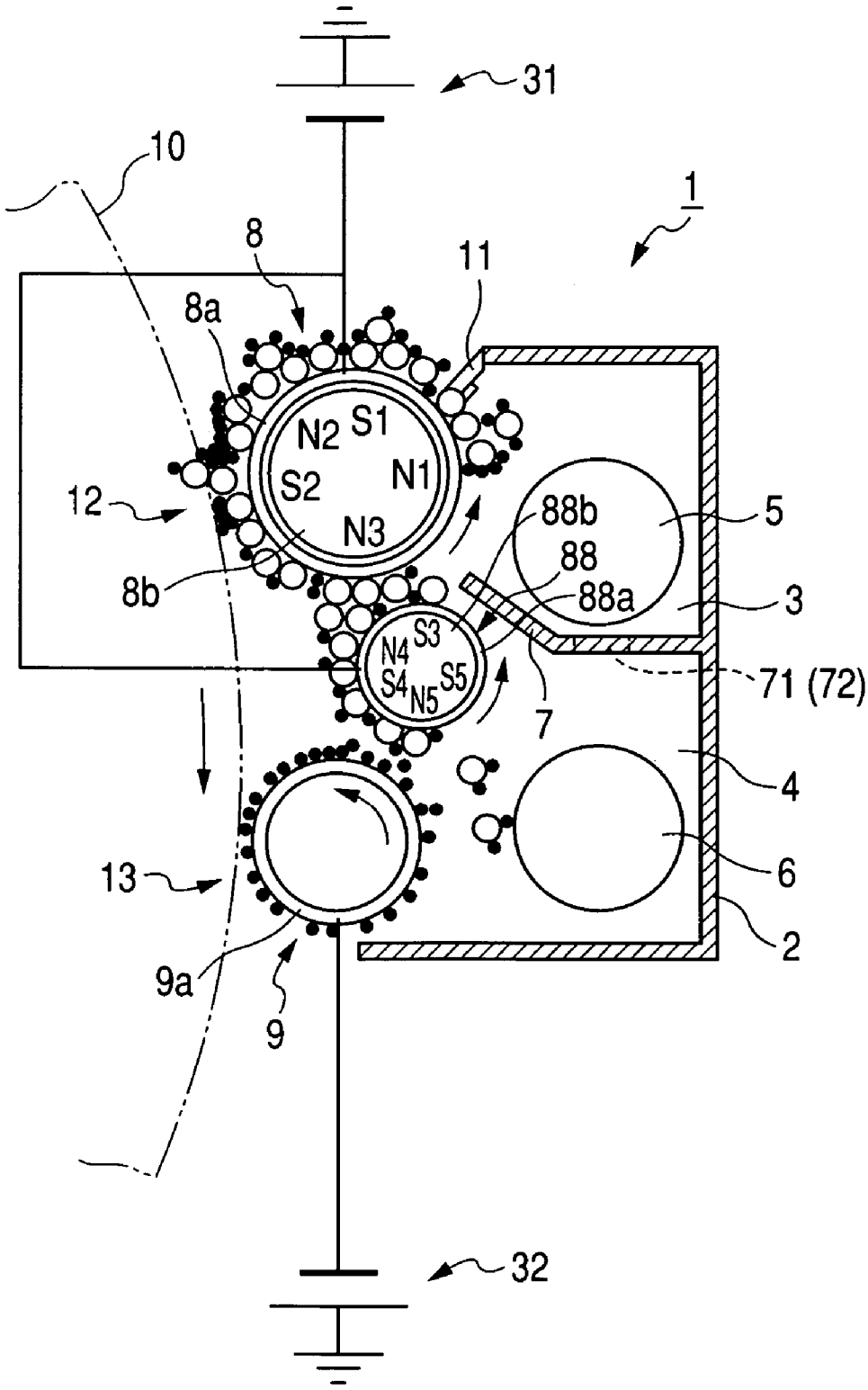
FIG. 5 is a cross-sectional view showing another embodiment of the developing device constructed in accordance with the present invention.

So, in the present embodiment, as shown in FIG. 5, a third developer carrying member 88 is provided as means for separating and conveying only the nonmagnetic toner to the developing sleeve 9*a* which is the second developer carrying member 9. The construction and action of the first and second developer carrying members 8 and 9 are similar to those in Embodiment 1, and the same reference numerals are given and the description of Embodiment 1 is invoked, and a detailed description need not be made again.

The third developer carrying member 88 is a roll-shaped nonmagnetic rotary member (developing roll), and in the present embodiment, the developing roll 88 has a rotatable nonmagnetic cylindrical member, i.e., a developing sleeve 88*a*, and a magnet roll 88*b* as magnetic field generating means fixed disposed in the interior of the developing sleeve 88*a*. A description will be further made with reference to FIG. 5.

The developing sleeve 88*a* of the third developing roll 88 is disposed in proximity to the first and second developing sleeves 8*a* and 9*a*. Also, the third developing sleeve 88*a* is rotated in the same direction as the first and second developing sleeves 8*a* and 9*a*, i.e., a counter-clockwise direction as viewed in FIG. 5. That is, the third developing sleeve 88*a* is rotated in the opposite direction in the portion thereof opposed to the first and second developing sleeves 8*a* and 9*a*. As required, the rotation direction and further, the peripheral speeds of these developing sleeves can be suitably changed.

In the present embodiment, the developer after the termination of the first developing step described in Embodiment 1 is delivered from a magnetic pole N3 downstream of the first developing portion 12 with respect to the rotation direction of the first developing sleeve 8*a* to the magnetic pole S3 of the magnet roll 88*b* which is magnetic field generating means provided against rotation in the third developing sleeve 88, whereafter the developer on the third developing sleeve 88*a* is conveyed to the interior of the developer container 2 by magnetic poles N4→S4→N5→S5 downstream with respect to the rotation direction of the third developing sleeve 88*a*, is removed from the third developing sleeve 88*a* by the repulsive magnetic field of the magnetic poles S3 and S5, and is collected into the agitating chamber 4 in the lower portion of the developer container 2.

In the present embodiment, in order to separate and convey only the nonmagnetic toner to the second developing sleeve 9*a*, DC biases of the same voltage were applied from a DC power source 31 as electric field generating means to the first and second developing sleeves 8*a* and 88*a* to thereby bring them into the same potential, and from a DC power source 32 connected to the second developing sleeve 9*a*, a DC bias was applied so that an electric potential difference might occur between the third developing sleeve 88*a* and the second developing sleeve 9*a*.

Figure 6:
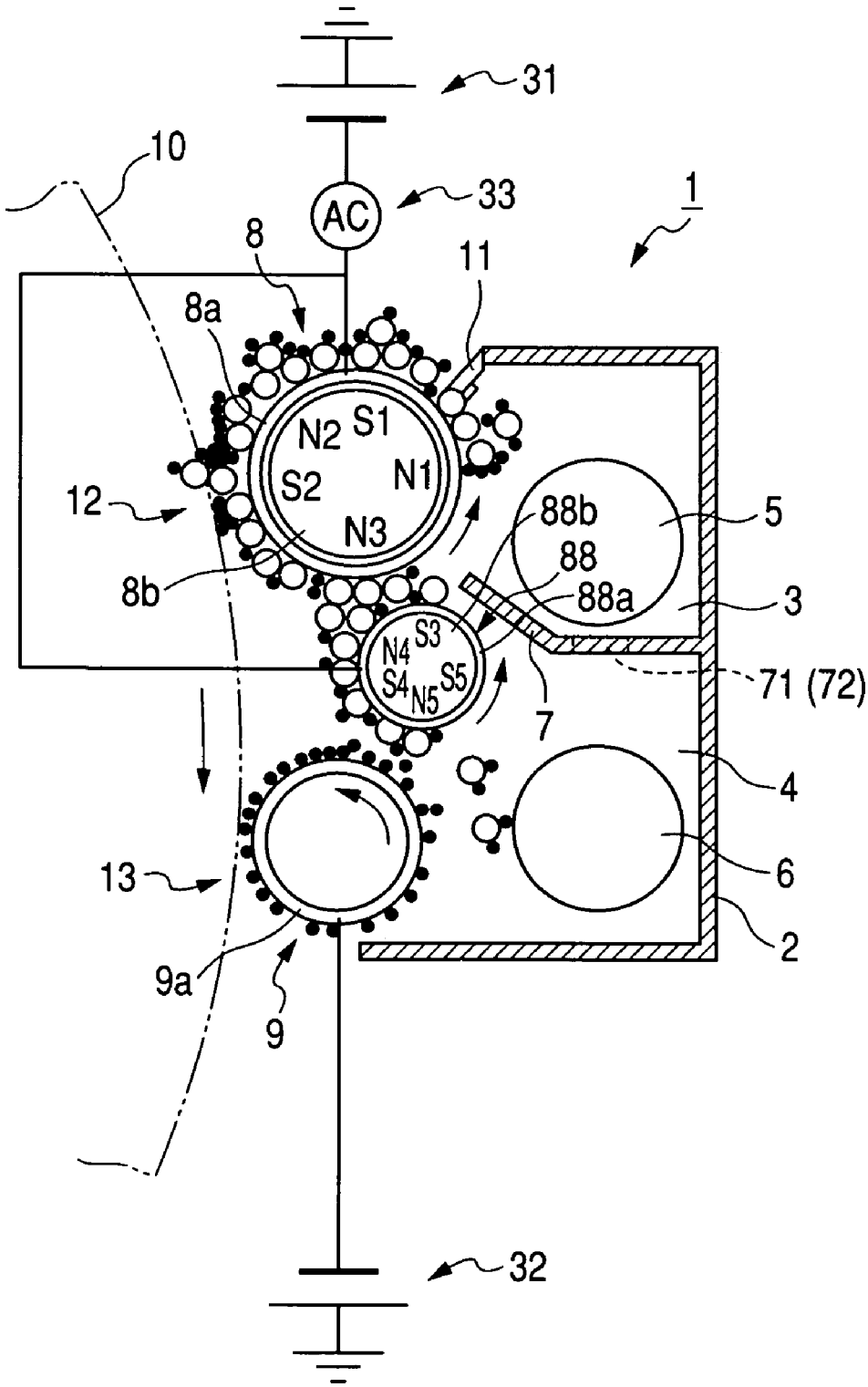
FIG. 6 is a cross-sectional view showing another embodiment of the developing device constructed in accordance with the present invention.

Also, as required, as shown in FIG. 6, it is also possible to further provide an AC power source 33, and apply to the first and third developing sleeves 8*a* and 88*a* a DC bias having an AC bias superimposed thereon. Although not shown, as required, it is also possible to provide an input voltage to the third developing sleeve 88*a* discretely from the DC power source to the first developing sleeve 8*a* to thereby effect further fine control.

Specifically, in FIG. 5, as in Embodiment 1, the dark portion potential of the photosensitive drum 10 was set to −700 V and the light portion potential thereof was set to −100 V, and −650 V was applied as a DC bias to the developing sleeve 8*a* and the developing sleeve 88*a*, and in order to provide to only the developing sleeve 9*a* an electric potential difference of 200 V between it and the developing sleeve 88*a*, −450 V was applied as a DC bias thereto.

As a result, due to the electric potential difference between the developing sleeves 88*a* and 9*a*, only the nonmagnetic toner is used for developing (jumping) or the developing sleeve 9*a*, and a coat of only a nonmagnetic toner layer can be achieved on the surface of the developing sleeve 9*a*.

Thereafter, the developing sleeve 9*a* is rotated, whereby the toner again comes to the second developing portion 13 in which the developing sleeve 9*a* and the photosensitive drum 10 are opposed to each other, and the second developing step is executed for the electrostatic image on the photosensitive drum 10.

In the present embodiment, the third developing roll 88 is adopted as the toner separating and conveying means, whereby the voltages applied to the first developing sleeve 8*a* and the third developing sleeve 88*a* can be made the same and therefore, the developing efficiency of the first developing step is not spoiled, and the separation of the toner is done not from the dual-component developer on the first developing sleeve 8*a* having counter charges immediately after the termination of development, but from the developer on the third developing sleeve 88*a* having had counter charges sufficiently leaked therefrom, and therefore toner supply to the second developing sleeve 9*a* can be effected stably.

As described above, according to the present embodiment, as in the case of Embodiment 1, the first developer carrying member carries thereon the dual-component developer contained in the developing device and effects the conveyance thereof to the first developing portion and the developing step, and the second developer carrying member carries thereon only the nonmagnetic toner in the dual-component developer and effects the conveyance thereof to the second developing portion and the developing step and therefore, at the second developing step, the earing by the magnetic carrier in the dual-component developer does not occur. Accordingly, the developer image formed by the first developer carrying member is not disturbed by the developer on the second developer carrying member and further, minute scavenging made at the first developing step can be removed to thereby obtain an image of high quality.

Further, in the present embodiment, the third developer carrying member is disposed to convey only the nonmagnetic toner onto the second developer carrying member and further, process conditions (the developing bias, SD, the shapes of the carrying members, peripheral speeds, etc.) applied to the first and second developer carrying members are optimally set, whereby without the developer image by the first developer carrying member being disturbed by the developer on the second developer carrying member, the prevention of scavenging is carried out and an image of high quality is obtained.

Embodiment 3

While in Embodiments 1 and 2, the peripheral speeds of the first developing roll 8 and the second developing roll 9 are substantially the same, in the present embodiment, the peripheral speeds of the first developing roll 8 and the second developing roll 9 can be made different from each other.

That is, the peripheral speed ratios of the first developing roll 8 and the second developing roll 9 to the peripheral speed of the photosensitive drum 10 are made different between the first developing roll 8 and the second developing roll 9, and in the present embodiment, the peripheral speed ratio of the first developing roll is made great as compared with the peripheral speed ratio of the second developing roll.

Specifically, SD between the second developing roll 9 and the photosensitive drum 10 at the second developing step is made zero (contact developing method). That is, as described in Embodiment 1, the second developing roll 9 is made into a construction in which an elastic layer is provided on the surface of the developing sleeve 9*a*, and is designed to be pressed against the photosensitive drum 10.

Also, in the present embodiment, by adopting the above-described construction, the speed ratio (peripheral speed ratio) of the second developing roll 9 to the peripheral speed of the photosensitive drum is 1 (that is, the same speed as the peripheral speed of the photosensitive drum). As a result, the toner collection rate to the developing roll which heretofore occurred when the contact developing method was adopted could be reduced, and the developing efficiency could be improved to thereby achieve still a higher quality of image.

Embodiment 4

In Embodiments 1, 2 and 3, the step of separating and conveying the toner during the conveyance of the developer is provided to effect the second developing step by only the nonmagnetic toner. As a result, at the second developing step, a noise component by the magnetic carrier could be removed to thereby achieve a higher quality of image.

In the present embodiment, in order to prevent the occurrence of the noise due to the magnetic carrier while the dual-component developer remains carried on the second developer carrying member, design is made such that the ears of the magnetic carrier carried on the second developer carrying member do not contact with the photosensitive drum.

Figure 7:
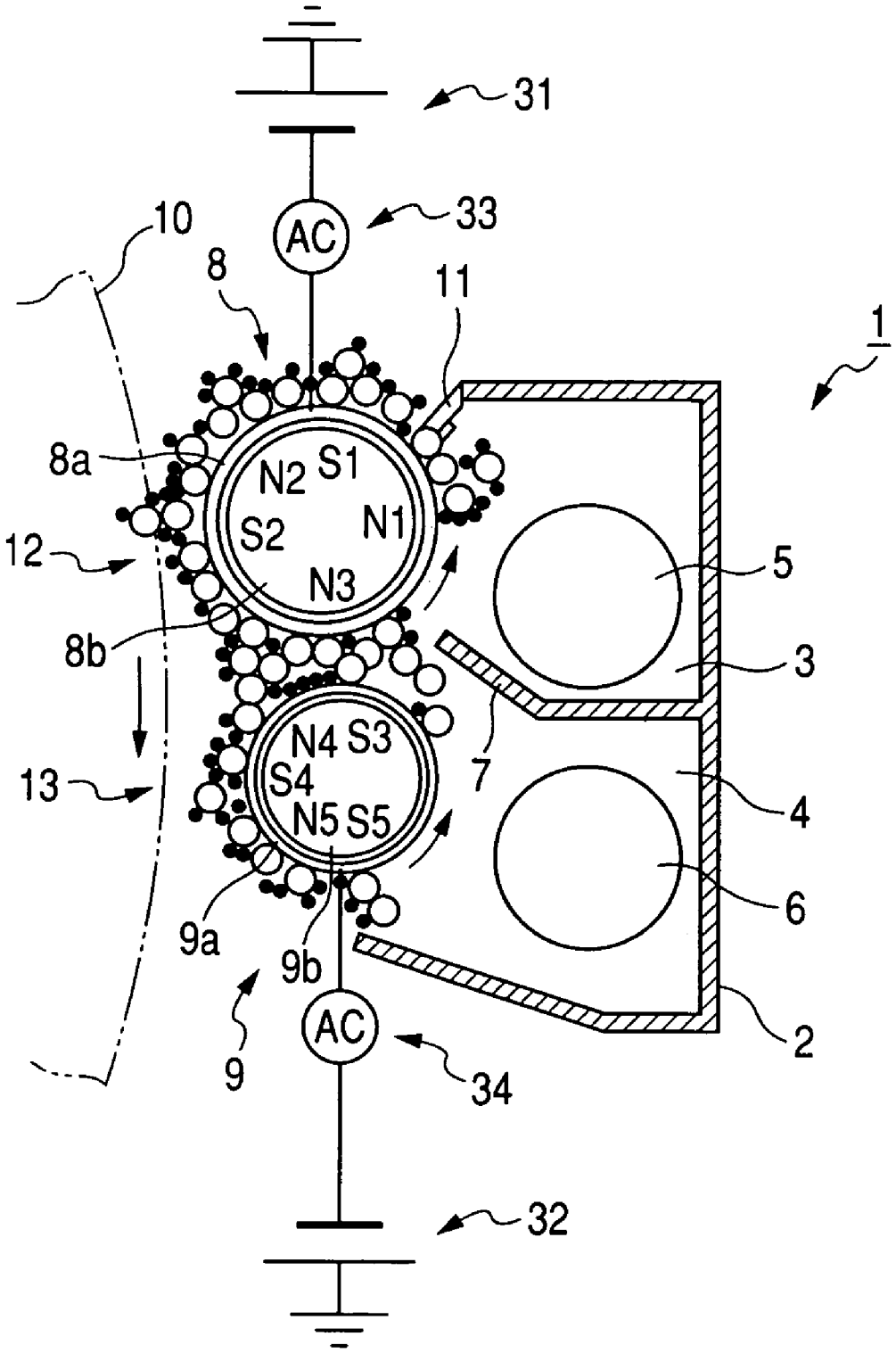
FIG. 7 is a cross-sectional view showing another embodiment of the developing device constructed in accordance with the present invention.
Figure 8:
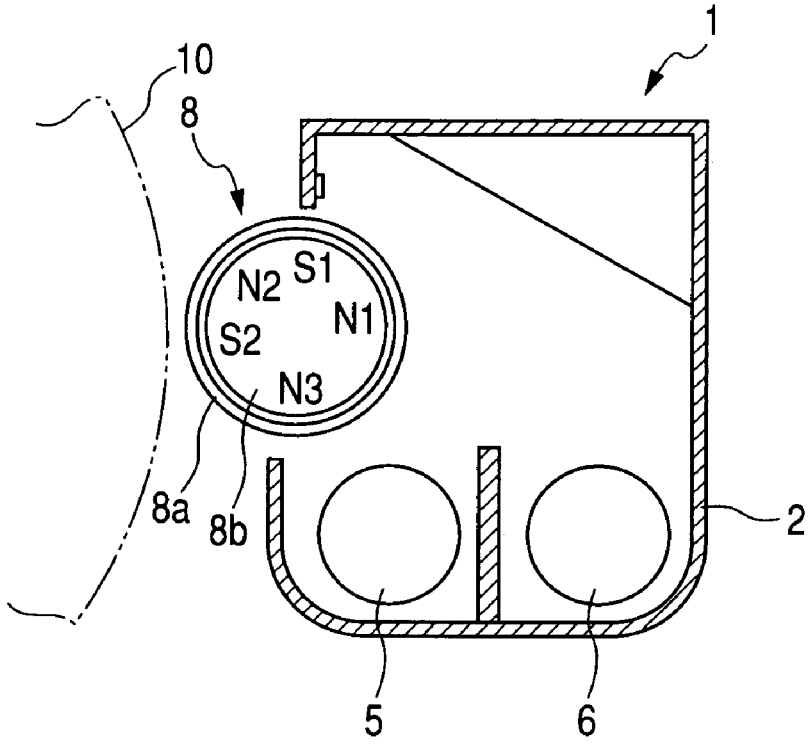
FIG. 8 is a cross-sectional view showing a conventional developing device.
Figure 9:
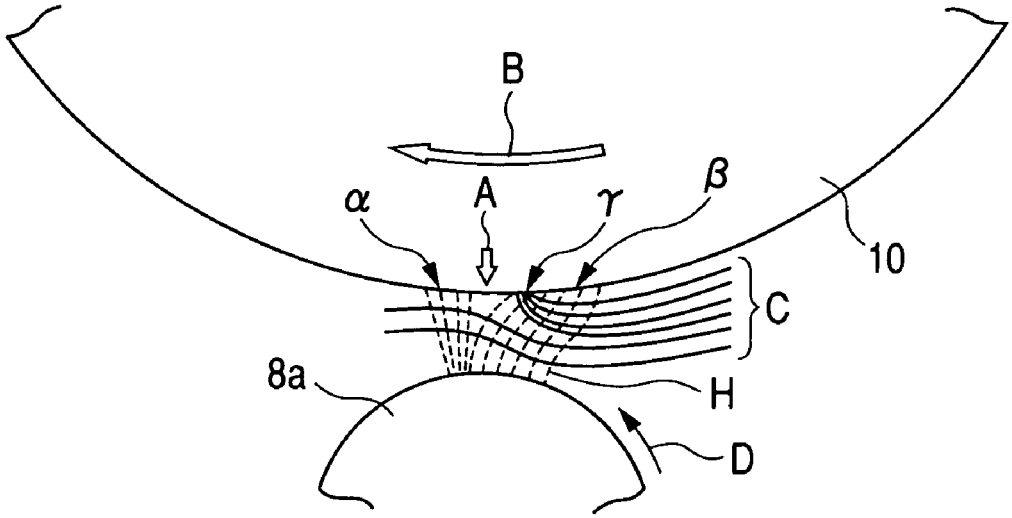
FIG. 9 is an illustration for illustrating the principle of occurrence of a blank image.
Figure 10:
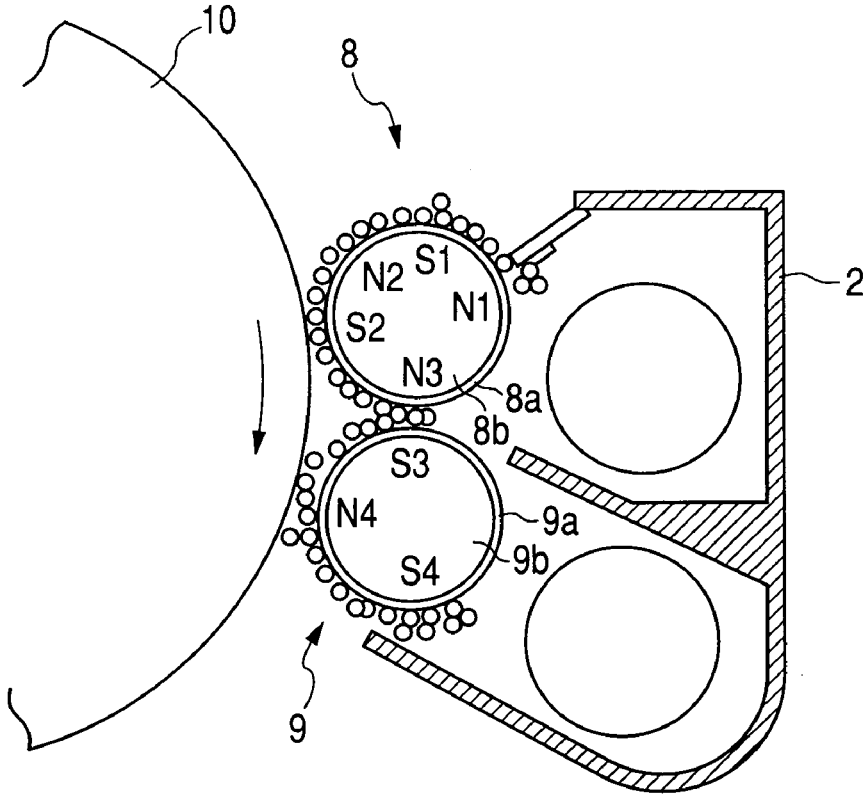
FIG. 10 is a cross-sectional view showing a conventional developing device.
Figure 11:
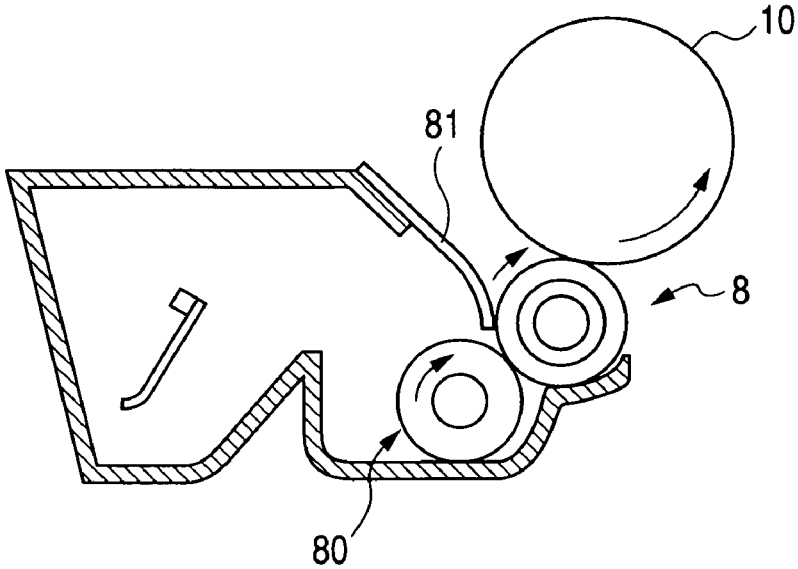
FIG. 11 is a cross-sectional view showing a conventional developing device.
Figure 12:
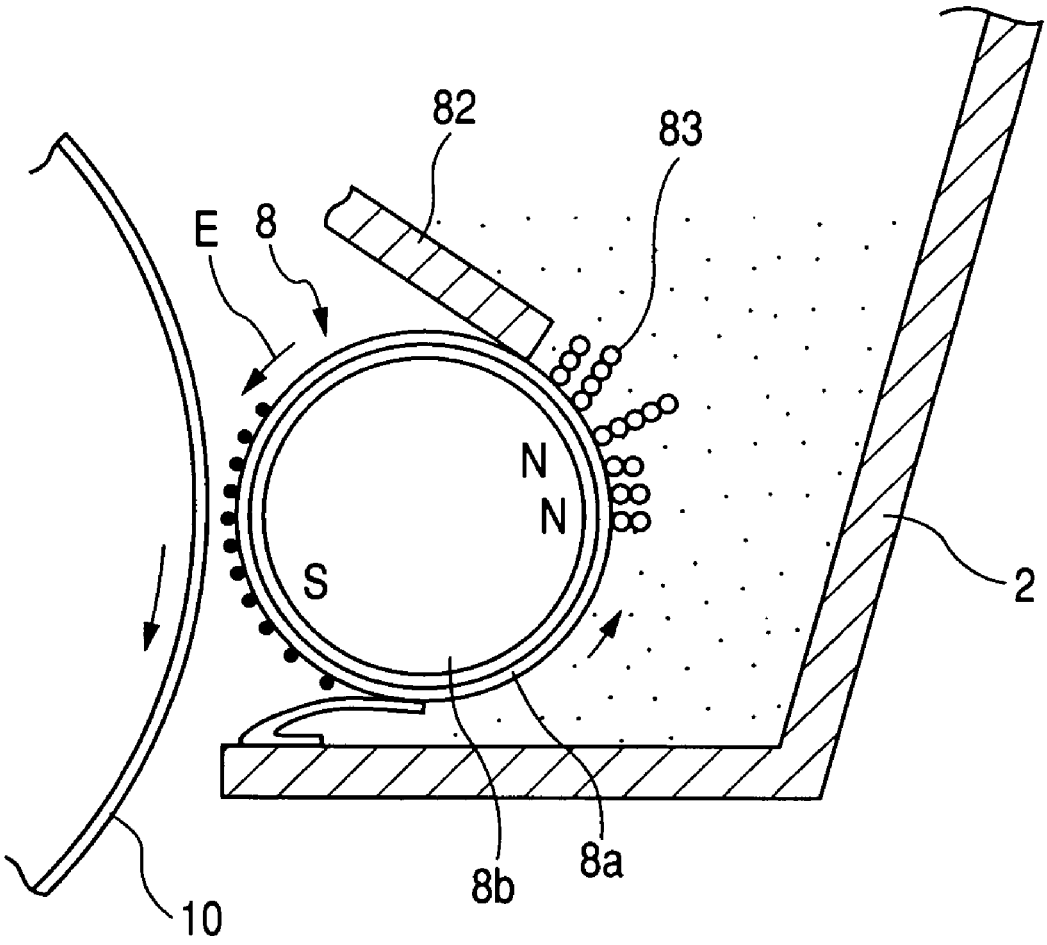
FIG. 12 is a cross-sectional view showing a conventional developing device.

So, in the present embodiment, as shown in FIG. 7, the second developing step is of a non-contact developing type still using a dual-component developer.

The first developing step is carried out by a construction similar to that in the previous embodiments, and the first developing roll 8 which is a first developer carrying member is formed by a nonmagnetic cylindrical rotary member, i.e., a developing sleeve 8*a*, and a magnet roll 8*b* which is fixed magnetic field generating means provided against rotation in the developing sleeve 8*a*.

In the present embodiment, the second developing roll 9 which is a second developer carrying member, like the first developing roll 8, is formed by a nonmagnetic cylindrical rotary member, i.e., a developing sleeve 9*a*, and a magnet roll 9*b* which is fixed magnetic field generating means provided against rotation in the developing sleeve 9*a*.

The rotation directions of the first and second developing sleeves 8*a* and 9*a* are the same direction (a counter-clockwise direction as viewed in FIG. 7) so as to be opposite to each other in an area wherein they are opposed to each other. As required, the rotation directions and further, the peripheral speeds of these developing sleeves can be suitably changed.

In the present embodiment, the developer after the termination of the first developing step is delivered from a magnetic pole N3 downstream of the first developing portion 12 with respect to the rotation direction of the first developing sleeve 8a to the magnetic pole S3 of the magnet roll 9*a* which is the magnetic field generating means provided against rotation in the second developing sleeve 9, whereafter the developer on the second developing sleeve 9*a* is conveyed to the interior of the developer container 2 by magnetic poles N4→S4→N5→S5 downstream with respect to the rotation direction of the second developing sleeve 9*a*, is removed from the second developing sleeve 9*a* by the repulsive magnetic field of the magnetic poles S3 and S5, and is collected into the agitating chamber 4 in the lower portion of the developer container 2.

According to the present embodiment, in the above-described construction, the closest distance between the developing sleeve 9*a* and the photosensitive drum 10 is set so that ears formed by the magnetic carrier of the dual-component developer carried on the second developing sleeve 9*a* may not contact with the surface of the photosensitive drum 10.

Specifically, when the height of the ears of the magnetic carrier is of the order of 1.2 mm, the distance between the first developing sleeve 8*a* and the photosensitive drum 10 is 0.8 mm (that is, the ears of the magnetic carrier contact with the surface of the photosensitive drum), whereas the distance between the second developing sleeve 9*a* and the photosensitive drum 10 is set to the order of 1.5 mm.

Thereby, there was of course no noise component due to the magnetic carrier because the second developing step was non-contact development, and it became also possible to collect the magnetic carrier adhering at the first developing step by the second developing sleeve 9*a*, and still a higher quality of image could be achieved.

In this case, in order to improve the developing property which poses a problem in the non-contact development, it is desirable to connect an AC power source 34 and a DC power source 32 to the second developing sleeve 9*a*, as shown in FIG. 7, and apply a vibration bias voltage comprising an AC voltage and a DC voltage superimposed thereon to thereby further gain the developing efficiency. Also, at this time, as the peak-to-peak voltage and frequency of the AC voltage applied to the second developing sleeve 9*a*, use can be made of the values shown, for example, in Embodiment 1.

Also, in the present embodiment, as shown, there is adopted a construction in which an AC power source 33 and a DC power source 31 are connected to the first developing sleeve 8*a* to thereby apply a vibration bias voltage comprising an AC voltage and a DC voltage superimposed thereon, but at this time, it is desirable that the peak-to-peak voltage applied to the second developing sleeve 9*a* be made greater than the peak-to-peak voltage applied to the first developing sleeve 8*a*.

While in the present embodiment, it has been described that as shown in FIG. 7, the DC power sources 31 and 32 and the AC power sources 33 and 34 as electric field generating means are connected to the first and second developing sleeves 8*a* and 9*a*, respectively, and a vibration bias comprising an AC voltage and a DC voltage superimposed thereon is applied, for example, at least one AC power source can be omitted as described in the previous embodiments. That is, the construction and voltage condition of the electric field generating means shown herein are an example and should be suitably changed in adaptation to an apparatus.

While the invention has been described with reference to the structure disclosed herein, it is not confined to the details set forth and this application is intended to cover such modifications or changes as may come within the purpose of the improvements or the scope of the following claims.

This application claims priority from Japanese Patent Application No. 2005-105458 filed on Mar. 31, 2005, which is hereby incorporated by reference herein.

What is claimed is:

1. An image forming apparatus comprising:

an image bearing member on which an electrostatic image is formed; and a developing device provided with a developer container containing a developer including a magnetic carrier and a nonmagnetic toner, and first and second developer carrying members disposed in an opening portion of said developer container in opposed relationship with said image bearing member for developing the electrostatic image on said image bearing member, wherein on said first developer carrying member, development is performed by a method whereby said magnetic carrier contacts with said image bearing member, and wherein on said second developer carrying member, development is performed by a method whereby said magnetic carrier does not contact with said image bearing member.

2. An image forming apparatus according to claim 1, wherein said first and second developer carrying members are moved in the same direction as said image bearing member in first and second developing portions, respectively, for developing the electrostatic image on said image bearing member.

3. An image forming apparatus according to claim 1 or 2, wherein said developing device has toner separating and conveying means for separating the nonmagnetic toner in said developer, and conveying the nonmagnetic toner to said second developer carrying member.

4. An image forming apparatus according to claim 3, wherein said toner separating and conveying means is said first developer carrying member.

5. An image forming apparatus according to claim 4, further comprising electric field generating means for generating an electric field between said first developer carrying member and said second developer carrying member, wherein the separation and conveyance of the toner from said first developer carrying member to said second developer carrying member are performed by an electric potential difference between said first developer carrying member and said second developer carrying member.

6. An image forming apparatus according to claim 3, wherein said toner separating and conveying means is a third developer carrying member disposed in proximity to said first and second developer carrying members.

7. An image forming apparatus according to claim 6, further comprising:

first electric field generating means for generating an electric field between said first developer carrying member and said third developer carrying member; and second electric field generating means for generating an electric field between said second developer carrying member and said third developer carrying member, wherein the separation and conveyance of the toner from said first developer carrying member to said third developer carrying member are performed by an electric potential difference between said first developer carrying member and said third developer carrying member, and wherein the conveyance of the toner from said third developer carrying member to said second developer carrying member is performed by an electric potential difference between said second developer carrying member and said third developer carrying member.

8. An image forming apparatus according to claim 5, wherein voltage waveforms applied to said first developer carrying member and said second developer carrying member are different in shape from each other.

9. An image forming apparatus according to claim 1 or 2, wherein peripheral speed ratios of said first developer carrying member and said second developer carrying member to a peripheral speed of said image bearing member are different from each other.

10. An image forming apparatus according to claim 9, wherein the peripheral speed ratio of said first developer carrying member is great as compared with the peripheral speed ratio of said second developer carrying member.

11. An image forming apparatus according to claim 1 or 2, wherein said first developer carrying member is formed by a nonmagnetic rotary member and magnetic field generating means fixed to an interior of said rotary member, and said second developer carrying member is formed by a nonmagnetic rotary member.

12. An image forming apparatus according to claim 6, wherein said third developer carrying member is formed by a nonmagnetic rotary member and magnetic field generating means fixed to an interior of said rotary member.

13. An image forming apparatus according to claim 11, wherein said first developer carrying member performs dual-component magnetic brush contact development for said image bearing member, and said second developer carrying member performs mono-component non-contact development for said image bearing member.

14. An image forming apparatus according to claim 1 or 2, wherein said first developer carrying member performs dual-component magnetic brush contact development for said image bearing member, and said second developer carrying member performs mono-component contact development for said image bearing member.

15. An image forming apparatus according to claim 1 or 2, wherein only the nonmagnetic toner is carried on said second developer carrying member.

* * * * *

UNITED STATES PATENT AND TRADEMARK OFFICE

CERTIFICATE OF CORRECTION

PATENT NO. : 7,231,168 B2
APPLICATION NO. : 11/140998
DATED : June 12, 2007
INVENTOR(S) : Fumitake Hirobe It is certified that error appears in the above-identified patent and that said Letters Patent is hereby corrected as shown below:

COLUMN 1

Line 55, "portion a" should read --portion α--;
Line 58, "portion a" should read --portion α--.

COLUMN 2

Line 20, "portion a" should read --portion α--;
Line 26, "dignity" should read --quality--.

COLUMN 12

Lines 47 through 49, "the earing by the magnetic carrier in the dual-component developer does not occur a the second developing step" should read --"earing" of the developer, i.e., when the magnetic carrier in the dual-component developer takes the shape of "ears of rice," does not occur in the second developing step--;

Lines 66 through 67, "these charges exist much in the magnetic carrier after the termination of development" should read --a great deal of the counter charges exists in the magnetic carrier after the termination of development.--.

COLUMN 13

Lines 5 and 6, "jumping coat onto the second developing sleeve 9 cannot be sufficiently done" should read --jumping toner from the first developing sleeve 8*a* to coat the second developing sleeve 9 cannot be sufficiently done--.

COLUMN 14

Line 1, "88*a*" should read --9*a*--.

Signed and Sealed this

Eighth Day of July, 2008

JON W. DUDAS
*Director of the United States Patent and Trademark Office*